US012704297B2

(12) United States Patent
Terry et al.

(10) Patent No.: US 12,704,297 B2
(45) Date of Patent: Aug. 11, 2026

(54) STIRLING REFRIGERATION SYSTEM

(71) Applicant: Carrier Corporation, Palm Beach Gardens, FL (US)

(72) Inventors: Clayton Terry, East Syracuse, NY (US); Sascha Hellmann, Hochheim am Main (DE); Subramanyaravi Annapragada, Alpharetta, GA (US); Mann Fai Yip, Singapore (SG); Chai Kheh Chew, Singapore (SG)

(73) Assignee: CARRIER CORPORATION, Palm Beach Gardens, FL (US)

( * ) Notice: Subject to any disclaimer, the term of this patent is extended or adjusted under 35 U.S.C. 154(b) by 183 days.

(21) Appl. No.: 18/404,036

(22) Filed: Jan. 4, 2024

(65) Prior Publication Data

US 2024/0219076 A1 Jul. 4, 2024

Related U.S. Application Data

(60) Provisional application No. 63/478,433, filed on Jan. 4, 2023.

(51) Int. Cl.
*F25B 9/14* (2006.01)
*F25B 41/40* (2021.01)

(52) U.S. Cl.
CPC ..... *F25B 9/14* (2013.01); *F25B 41/40* (2021.01)

(58) Field of Classification Search
CPC .. F25B 9/14; F25B 41/40; F25B 41/00; F25B 2400/12; F25B 2400/16
See application file for complete search history.

(56) References Cited

U.S. PATENT DOCUMENTS

| | | | |
|---|---|---|---|
| 7,216,494 | B2 | 5/2007 | Thurman |
| 8,161,760 | B2 | 4/2012 | Cur et al. |
| 8,336,322 | B2 | 12/2012 | Cur et al. |
| 9,625,183 | B2 | 4/2017 | Wallace et al. |
| 9,689,590 | B2 | 6/2017 | Christensen |
| 9,709,302 | B2 | 7/2017 | Martin et al. |

(Continued)

FOREIGN PATENT DOCUMENTS

| | | | |
|---|---|---|---|
| CN | 203257561 | U | 10/2013 |
| CN | 213578187 | U | 6/2021 |

(Continued)

OTHER PUBLICATIONS

Extended European Search Report received for EP Application No. 24150402.6, mailed on May 28, 2024, 5 Pages.

*Primary Examiner* — Marc E Norman
(74) *Attorney, Agent, or Firm* — Drew Folgmann

(57) ABSTRACT

A Stirling refrigeration system is disclosed that comprises a Stirling unit having a hot end and a cold end. In addition, the Stirling refrigeration system includes a hot heat exchanger fluidically coupled to the hot end and configured to release the heat form the hot end, wherein the hot heat exchanger and the hot end define a hot circuit for a first refrigerant to flow therein. Further, the Stirling refrigeration system includes a cold heat exchanger fluidically coupled to the cold end and configured to remove the heat from the cold end, wherein the cold heat exchanger and the cold end define a cold circuit for a second refrigerant to flow therein. One of the first refrigerant and the second refrigerant comprises a two-phase low GWP refrigerant.

11 Claims, 4 Drawing Sheets

(56) References Cited

U.S. PATENT DOCUMENTS

| | | | | |
|---|---|---|---|---|
| 10,830,499 | B2 | 11/2020 | Rajendiran et al. | |
| 2005/0016184 | A1 | 1/2005 | Zhang et al. | |
| 2005/0210885 | A1* | 9/2005 | Pereira | F28D 15/043 62/6 |
| 2007/0220910 | A1 | 9/2007 | Schierhorn | |
| 2008/0156028 | A1 | 7/2008 | Cur et al. | |
| 2010/0212350 | A1 | 8/2010 | Gu et al. | |
| 2012/0216551 | A1 | 8/2012 | Minor et al. | |
| 2013/0305757 | A1 | 11/2013 | Conjeevaram et al. | |
| 2020/0348056 | A1 | 11/2020 | Street et al. | |
| 2024/0110742 | A1* | 4/2024 | Gerner | F25D 11/04 |
| 2025/0027688 | A1* | 1/2025 | Hill | F24D 3/18 |

FOREIGN PATENT DOCUMENTS

| | | | |
|---|---|---|---|
| JP | 2006145210 | A | 6/2006 |
| WO | 2007080708 | A1 | 7/2007 |
| WO | 2016117995 | A1 | 7/2016 |

* cited by examiner

100

STIRLING REFRIGERATION SYSTEM

CROSS REFERENCE TO RELATED APPLICATION

This application claims the benefit of U.S. Provisional Patent Application No. 63/478,433 filed on Jan. 4, 2023, which is incorporated by reference herein in its entirety.

FIELD OF THE INVENTION

The disclosure relates to a Stirling-powered refrigeration system.

BACKGROUND

Refrigeration systems are employed commercially in supermarkets to store perishables. Typically, the commercially used refrigeration system is a vapour compression-based system that relies on a refrigerant to perform the cooling operation. One type of vapour compression refrigeration system is a cascade type of refrigeration that has a medium-temperature stage and a low-temperature stage, such that vapour compression is performed at the two stages to achieve a very low temperature for deep freezing application. Further, the medium temperature stage of the cascade type of refrigeration system may be used for perishable items that do not require deep freezing.

There are a few limitations of the conventional cascade-type refrigeration system. For instance, cascade-type refrigeration uses a single refrigerant for both the lower temperature stage and the medium temperature stage, which is compressed by a separate compressor, thereby increasing the complexity of the refrigeration system.

SUMMARY

This summary is provided to introduce a selection of concepts, in a simplified format, that are further described in the detailed description of the invention. This summary is neither intended to identify key or essential inventive concepts of the invention nor intended for determining the scope of the invention.

Disclosed herein is a Stirling refrigeration system comprising a Stirling unit. The Stirling unit comprises a hot end and a cold end. In addition, the Stirling refrigeration system includes a hot heat exchanger fluidically coupled to the hot end and configured to release heat from the hot end, wherein the hot heat exchanger and the hot end define a hot circuit for a first refrigerant to flow therein. The Stirling refrigeration system also includes a cold heat exchanger fluidically coupled to the cold end and configured to release heat to the cold end, wherein the cold heat exchanger and the cold end define a cold circuit for a second refrigerant to flow therein, wherein at least one of the first refrigerant and the second refrigerant comprise a two-phase low Global Warming Potential (GWP) refrigerant.

In one or more embodiments, the low GWP refrigerant has a global warming potential of 0 to 150.

In one or more embodiments, at least one of the first refrigerant and the second refrigerant includes R471A, R516A, R455A, R454C, R454A, R1132, R1234ze, R1234yf, R290, R600, R600a, R744, R1270, and R480A (Mix of R600a and R1270) refrigerant.

In one or more embodiments, the hot circuit further comprises a first hose configured to couple an inlet port of the hot end to an outlet port of the hot heat exchanger, a first pump having an inlet port and an outlet port, a second hose configured to couple an inlet port of the first pump to an outlet port of the hot end, and a third hose configured to couple the outlet port of the first pump to an inlet port of the hot heat exchanger.

In one or more embodiments, the cold circuit further comprises a first hose configured to couple an inlet port of the cold end to an outlet port of the cold heat exchanger, a second pump having an inlet port and an outlet port, a second hose configured to couple an inlet port of the second pump to an outlet port of the cold end, and a third hose configured to couple the outlet port of the second pump to an inlet port of the cold heat exchanger.

In one or more embodiments, the Stirling refrigeration system comprises a reservoir fluidically coupled to the first hose of the cold circuit and configured to store the second refrigerant for supplying to the cold circuit.

In one or more embodiments, the hot circuit further comprises a first hose configured to couple an inlet port of the hot end to an outlet port of the hot heat exchanger, and a second hose configured to couple an outlet port of the hot end to an inlet port of the hot heat exchanger.

In one or more embodiments, the cold circuit further comprises a first hose configured to couple an inlet port of the cold end to an outlet port of the cold heat exchanger, and a second hose configured to couple an outlet port of the cold end to an inlet port of the cold heat exchanger.

In one or more embodiments, the first hose and the second hose of each of the hot circuit and the cold circuit are sized to supply the first refrigerant and the second refrigerant by a thermosyphon effect.

In one or more embodiments, the Stirling refrigeration system further comprises a medium-temperature refrigeration system. The medium-temperature refrigeration system comprises a compressor configured to compress a third refrigerant to form compressed refrigerant, a condenser fluidically coupled to the compressor to remove heat from the compressed refrigerant to form a condensed refrigerant, a fluid exchanger having a first inlet port fluidically coupled to the condenser configured to receive the condensed refrigerant, a first outlet port, a second inlet port, and a second outlet port fluidically coupled to an inlet port of the compressor. The medium-temperature refrigeration system comprises at least one injector having a first inlet port fluidically coupled to the first outlet port of the fluid exchanger configured to receive condensed refrigerant; and a second inlet port fluidically configured to receive a stream of hot refrigerant, wherein the at least one injector mixes the stream of hot refrigerant with condensed refrigerant to form mixed stream of refrigerant. The medium-temperature refrigeration system also includes a reservoir installed downstream to the at least one injector and configured to store the third refrigerant, the reservoir having a first inlet port fluidically coupled to an outlet port of the at least one injector, a first outlet port, and a second outlet port fluidically coupled to the second inlet port of the fluid exchanger, a pump installed downstream to the reservoir, wherein an inlet port of the pump is fluidically coupled to the first outlet port of the reservoir to receive the mixed stream of refrigerant, and an evaporator installed downstream to the pump and configured to transfer heat from a space to the mixed stream of refrigerant to form the stream of hot refrigerant, wherein an outlet port of the evaporator is fluidically coupled to the first inlet port of the at least one injector.

In one or more embodiments, an apparatus for cooling a space comprises a Stirling refrigeration system configured to maintain temperature of the space below a first temperature.

The Stirling refrigeration system comprises a Stirling unit comprising a hot end and a cold end, a hot heat exchanger fluidically coupled to the hot end and configured to release the heat form the hot end, wherein the hot heat exchanger and the hot end define a hot circuit for a first refrigerant to flow therein. A cold heat exchanger is fluidically coupled to the cold end and configured to release the heat form the cold end, wherein the cold heat exchanger and the cold end define a cold circuit for a second refrigerant to flow therein, wherein at least one of the first refrigerant and the second refrigerant comprises a two-phase low Global Warming Potential (GWP) refrigerant. The apparatus also comprises a vapour compression refrigeration system configured to maintain temperature of the space below a second temperature, wherein the second temperature is greater than the first temperature, In one or more embodiments, the low GWP refrigerant has a global warming potential of 0 to 150.

In one or more embodiments, the at least one of the first refrigerant and the second refrigerant includes R471A, R516A, R455A, R454C, R454A, R1132, R1234ze, R1234yf, R290, R600, R600a, R744, R1270, or R480A (Mix of R600a and R1270) refrigerant.

In one or more embodiments, the vapour compression refrigeration comprises a compressor configured to compress a third refrigerant to form compressed refrigerant, a condenser fluidically coupled to the compressor to remove heat from the compressed refrigerant to form a condensed refrigerant, a fluid exchanger having a first inlet port fluidically coupled to the condenser configured to receive the condensed refrigerant; a first outlet port; a second inlet port; and a second outlet port fluidically coupled to an inlet port of the compressor, at least one injector having a first inlet port fluidically coupled to the first outlet port of the fluid exchanger, wherein the at least one injector mixes a stream of hot refrigerant with condensed refrigerant to form mixed stream of refrigerant, a reservoir installed downstream to the at least one injector and configured to store the third refrigerant, the reservoir having a first inlet port fluidically coupled to an outlet port of the at least one injector; a first outlet port; and a second outlet port fluidically coupled to the second inlet port of the fluid exchanger, a pump installed downstream to the reservoir, wherein an inlet port of the pump is fluidically coupled to the first outlet port of the reservoir to receive the mixed stream of refrigerant; and an evaporator installed downstream to the pump and configured to transfer heat from a space to the mixed stream of refrigerant to form the stream of hot refrigerant, wherein an outlet port of the evaporator is fluidically coupled to the first inlet port of the at least one injector.

In one or more embodiments, the hot circuit further comprises a first hose configured to couple an inlet port of the hot end to an outlet port of the hot heat exchanger, a first pump having an inlet port and an outlet port, a second hose configured to couple an inlet port of the first pump to an outlet port of the hot end, and a third hose configured to couple the outlet port of the first pump to an inlet port of the hot heat exchanger.

In one or more embodiments, the cold circuit further comprises a first hose configured to couple an inlet port of the cold end to an outlet port of the cold heat exchanger, a second pump having an inlet port and an outlet port, a second hose configured to couple an inlet port of the second pump to an outlet port of the cold end, and a third hose configured to couple the outlet port of the second pump to an inlet port of the cold heat exchanger.

In one or more embodiments, the apparatus comprises a reservoir fluidically coupled to first hose of the cold circuit and configured to store the first refrigerant for supplying to the cold circuit.

In one or more embodiments, the hot circuit further comprises a first hose configured to couple an inlet port of the hot end to an outlet port of the hot heat exchanger and a second hose configured to couple an outlet port of the hot end to an inlet port of the hot heat exchanger In one or more embodiments, the cold circuit further comprises a first hose configured to couple an inlet port of the cold end to an outlet port of the cold heat exchanger, and a second hose configured to couple an outlet port of the cold end to an inlet port of the cold heat exchanger.

In one or more embodiments, the first hose and the second hose of each of the hot circuit and the cold circuit are sized to supply the first refrigerant and the second refrigerant by a thermosyphon effect.

The refrigeration system disclosed herein uses natural or low GWP refrigerant. Low GWP refrigerants have a decreased impact on the environment. Moreover, the use of a Stirling unit makes the refrigeration system more efficient compared to a compressor-based refrigeration system.

To further clarify advantages and features, a more particular description will be rendered by reference to specific embodiments thereof, which is illustrated in the appended drawings. It is appreciated that these drawings depict only typical embodiments and are therefore not to be considered limiting of its scope. The invention will be described and explained with additional specificity and detail with the accompanying drawings.

BRIEF DESCRIPTION OF THE DRAWINGS

These and other features, aspects, and advantages will become better understood when the following detailed description is read with reference to the accompanying drawings in which like characters represent like parts throughout the drawings, wherein.

Figure 1:
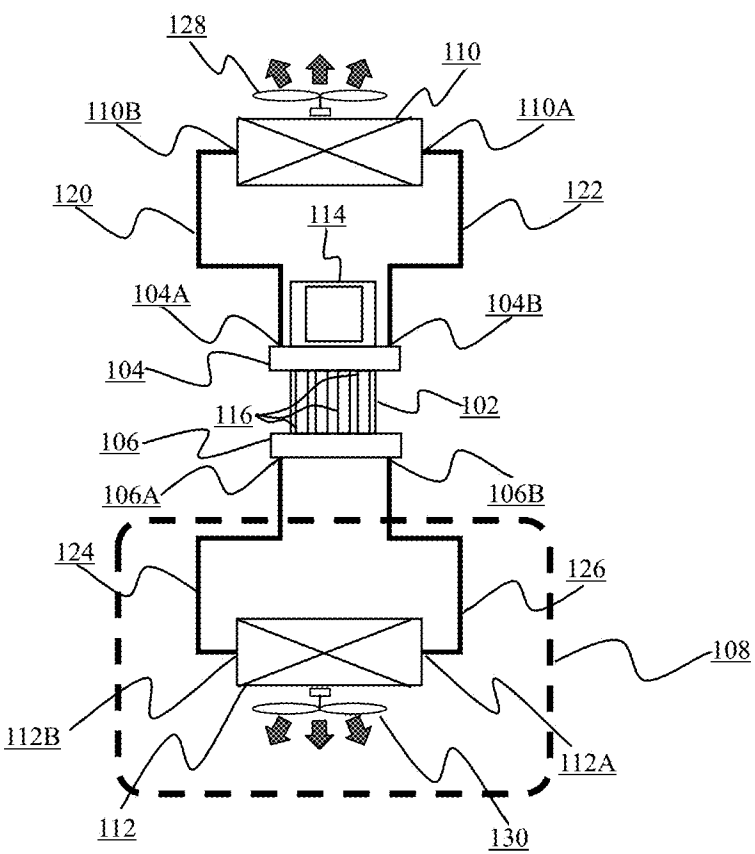
FIG. 1 illustrates a schematic view of a Stirling refrigeration system having a first refrigerant flowing under a thermosyphon effect.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having the benefit of the description herein.

DETAILED DESCRIPTION OF FIGURES

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which invention belongs. The system and examples provided herein are illustrative only and not intended to be limiting.

For example, the term "some" as used herein may be understood as "none" or "one" or "more than one" or "all." Therefore, the terms "none," "one," "more than one," "more than one, but not all" or "all" would fall under the definition of "some." It should be appreciated by a person skilled in the art that the terminology and structure employed herein is for describing, teaching, and illuminating some embodiments and their specific features and elements and therefore, should not be construed to limit, restrict or reduce the spirit and scope of the disclosure in any way.

For example, any terms used herein such as, "includes," "comprises," "has," "consists," and similar grammatical variants do not specify an exact limitation or restriction, and certainly do not exclude the possible addition of one or more features or elements, unless otherwise stated. Further, such terms must not be taken to exclude the possible removal of one or more of the listed features and elements, unless otherwise stated, for example, by using the limiting language including, but not limited to, "must comprise" or "needs to include."

Whether or not a certain feature or element was limited to being used only once, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language including, but not limited to, "there needs to be one or more . . . " or "one or more elements is required."

Unless otherwise defined, all terms and especially any technical and/or scientific terms, used herein may be taken to have the same meaning as commonly understood by a person ordinarily skilled in the art.

Reference is made herein to some "embodiments." It should be understood that an embodiment is an example of a possible implementation of any features and/or elements of the disclosure. Some embodiments have been described for the purpose of explaining one or more of the potential ways in which the specific features and/or elements of the proposed disclosure fulfil the requirements of uniqueness, utility, and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or other variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or in the context of more than one embodiment, or in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not necessarily be taken as limiting factors to the proposed disclosure.

Embodiments of the present invention will be described below in detail with reference to the accompanying drawings.

For the sake of clarity, the first digit of a reference numeral of each component of the disclosure is indicative of the Figure number, in which the corresponding component is shown. For example, reference numerals starting with digit "1" are shown at least in FIG. 1. Similarly, reference numerals starting with digit "2" are shown at least in FIG. 2.

FIG. 1 illustrates a schematic view of a Stirling refrigeration system 100, according to an embodiment of this disclosure. The Stirling refrigeration system 100 may be used to cool a space 108. The space 108, in one example, can be a refrigerator configured to store perishable food items. The space 108 may also include a plurality of refrigerator stacks. The space 108 can be cooled by the Stirling refrigeration system 100 which employs a Stirling unit 102. The Stirling unit 102, sometimes called the Stirling pump or Stirling compressor, is a mechanical heat pump that operates on the Stirling cycle. The Stirling unit 102 forms the centre of the operation of the Stirling refrigeration system 100 and is designed to run two refrigerants, namely a first refrigerant and a second refrigerant, which can be the same refrigerant or different refrigerants. The first refrigerant and the second refrigerant may be a two-phase low GWP refrigerant. Further, the low GWP refrigerant has a low impact on the environment. The low GWP refrigerant has a global warming potential (GWP) of 0 to 150. Two-phase refrigerants are refrigerants which undergo a phase change in the cooling cycle. Exemplary low GWP refrigerants include carbon dioxide (R744), an HFO, an HFO blend, a hydrocarbon or a combination thereof. The HFO/HFO blend refrigerant can be one of R471A, R516A, R455A, R454C, R454A, R1132, R1234ze, R1234yf, R290, R600, R600a, R1270, and R480A (Mix of R600a and R1270) refrigerant. In some embodiments, the first and second refrigerants comprise R744 or, in other words, carbon dioxide.

The Stirling unit 102 may include a motor 114, for example, an electric motor. The Stirling unit 102 may include a plurality of cylinders 116 each having a displacer piston (not shown), a power piston (not shown), a regenerator (not shown), and a working fluid inside (not shown). In one example, the working fluid can be carbon dioxide. The displacer pistons and the power piston may be coupled with motor 114 such that both the displacer pistons and the power pistons reciprocate inside their respective cylinders 116. Further, the displacer pistons in each cylinder 116 divide the cylinders 116 into a hot region and a cold region. Furthermore, the hot region of all the cylinders 116 collectively forms a hot end 104 of the Stirling unit 102. On the other side, the cold region of all the cylinders 116 collectively forms a cold end 106 of the Stirling unit 102.

In one example, the cold end 106 is responsible for absorbing heat from the space 108 through the second refrigerant while the hot end is responsible for discharging the absorbed heat to the environment through the first refrigerant. Although not shown, the hot end 104 and the cold end 106 may include fins to enhance heat transfer with the first refrigerant and the second refrigerant respectively.

The Stirling refrigeration system 100 includes other components that are fluidically coupled to the hot end 104 and the cold end 106. In one example, the Stirling refrigeration system 100 may include a hot heat exchanger 110 which is fluidically coupled to the hot end 104. The hot heat exchanger 110 and the hot end 104 form a hot circuit for the first refrigerant, such that the heat extracted by the first refrigerant from the hot end 104 via its fins can be transferred to the hot heat exchanger 110 for dissipation. The hot circuit may include other components that fluidically couple the hot end 104 and the hot heat exchanger 110. In one example, the hot circuit may include a first hose 120 that fluidically couples an inlet port 104A of the hot end 104 to an outlet port 110B of the hot heat exchanger 110. In addition, the hot circuit includes a second hose 122 that fluidically couples an outlet port 104B of the hot end 104 to an inlet port 110A of the hot heat exchanger 110. In one example, the first hose 120 and the second hose 122 are sized to allow the flow of the first refrigerant by the thermosyphon effect.

The Stirling refrigeration system 100 may include a cold heat exchanger 112 that, together with the cold end 106 forms a cold circuit for the second refrigerant to flow therein. In one example, the cold circuit may also have a first hose 124 that fluidically couples an inlet port 106A of the cold end 106 to an outlet port 112B of the cold heat exchanger 112. In addition, the cold circuit may include a second hose 126 that fluidically couples an outlet port 106B of the cold end 106 to an inlet port 112A of the cold heat exchanger 112. In some embodiments, the first hose 124 and the second hose 126 are sized to allow the flow of the first refrigerant by the thermosyphon effect.

In addition to the sizing of the hoses, the flow of the first refrigerant and the second refrigerant in the hot circuit and the cold circuit respectively is enhanced by placing the hot heat exchanger 110 and the cold heat exchanger 112 at different altitudes with respect to the Stirling unit 102. For instance, the hot heat exchanger 110 may be positioned higher than the hot end 104 thereby creating a pressure head, i.e., a pressure difference, between the hot heat exchanger 110 and the hot end 104. Thus, the first refrigerant flows from the hot end 104 to the hot heat exchanger 110 under the thermosyphon effect while the first refrigerant returns from the hot heat exchanger 110 to the hot end 104 under the pressure head. Accordingly, the combination of pressure head and thermosyphon effect ensures the uninterrupted flow of the first refrigerant in the hot circuit. Similarly, the cold heat exchanger 112 is positioned at an altitude lower than the cold end 106 thereby creating a pressure head between the cold heat exchanger 112 and the cold end 106. The second refrigerant flows from the cold end 106 to the cold heat exchanger 112 by pressure head while the second refrigerant flows back from the cold heat exchanger 112 to the cold end 106 by a thermosyphon effect.

During the operation, the motor 114 may be activated to actuate the power piston and the displacer piston with the cylinder 116. As these components operate, the working fluid cools the cold end 106 and simultaneously heats the hot end 104. At the hot end 104, the first refrigerant absorbs the heat. Since the temperature of the first refrigerant inside the hot end 104 is greater than the first refrigerant in the first hose 120 and at the inlet port 110A of the hot heat exchanger 110, a temperature gradient is created which causes the first refrigerant to exit through the outlet port 104B due to the thermosyphon effect and travel to the hot heat exchanger 110. Inside the hot heat exchanger 110, the first refrigerant rejects its heat to ambient air. Further, to increase the heat rejection, a hot heat exchanger fan 128 increases airflow. The rejection of heat cools the first refrigerant within the hot heat exchanger 110. Further, the egress of the first refrigerant from the hot end 104 causes suction in the second hose 122 to pull the now-cooled first refrigerant from the hot heat exchanger 110. In addition, the pressure head between the hot heat exchanger 110 and the hot end 104 ensures the first refrigerant flows back to the hot end 104 thereby completing one cycle. This cycle repeats to extract heat from the hot end 104.

On the other side of the Stirling unit 102 in the cold circuit, the second refrigerant inside the cold heat exchanger 112 may absorb the heat from the space 108 thereby heating the second refrigerant. Further, the fan 130 of the cold heat exchanger 112 increases air flow from the space 108 through the cold heat exchanger 112 to increase heat rejection. As may be understood, the heat rejection causes the temperature of the air within the space 108 to drop thereby creating conditions to store perishable items. Further, as the absorbed heat of the second refrigerant increases the heat of the working fluid in the cold end 106, a temperature gradient is created resulting in the second refrigerant exiting the outlet port 112B of the cold heat exchanger 112 and flowing towards the cold end 106 under thermosyphon effect. The egress of the second refrigerant from the cold heat exchanger 112 causes suction in the second hose 126. As the hot second refrigerant enters the cold end 106, the second refrigerant discharges its heat to the working fluid thereby cooling the second refrigerant. Simultaneously, suction in the second hose 126 is compounded with the pressure head between the cold end 106 and the cold heat exchanger 112 resulting in the flow of the second refrigerant present in the cold end 106 toward the cold heat exchanger 112. The second refrigerant now returns to the cold end 106 to collect the heat from the space 108 thereby completing a single cycle.

The above-mentioned process repeats constantly and removes a large amount of heat from the space 108 thereby allowing achieving a very low temperature, as low as −40 degrees Celsius. Further, the use of carbon dioxide also enables a large amount of heat removal for a defined space size thereby enabling the Stirling refrigeration system 100 to be compact. Moreover, the thermosyphon effects enable transfers of the first and second refrigerant without any mechanical device thereby minimizing the losses and resulting in an increase in the efficiency of the Stirling refrigeration system 100.

According to this disclosure, the operation of the Stirling refrigeration system 100 may be enhanced for large-volume cooling. One of the ways to enhance the operation is to use the pumps for circulating the refrigerants. Such an exemplary embodiment is explained with respect to FIGS. 2 and 3.

Figure 2:
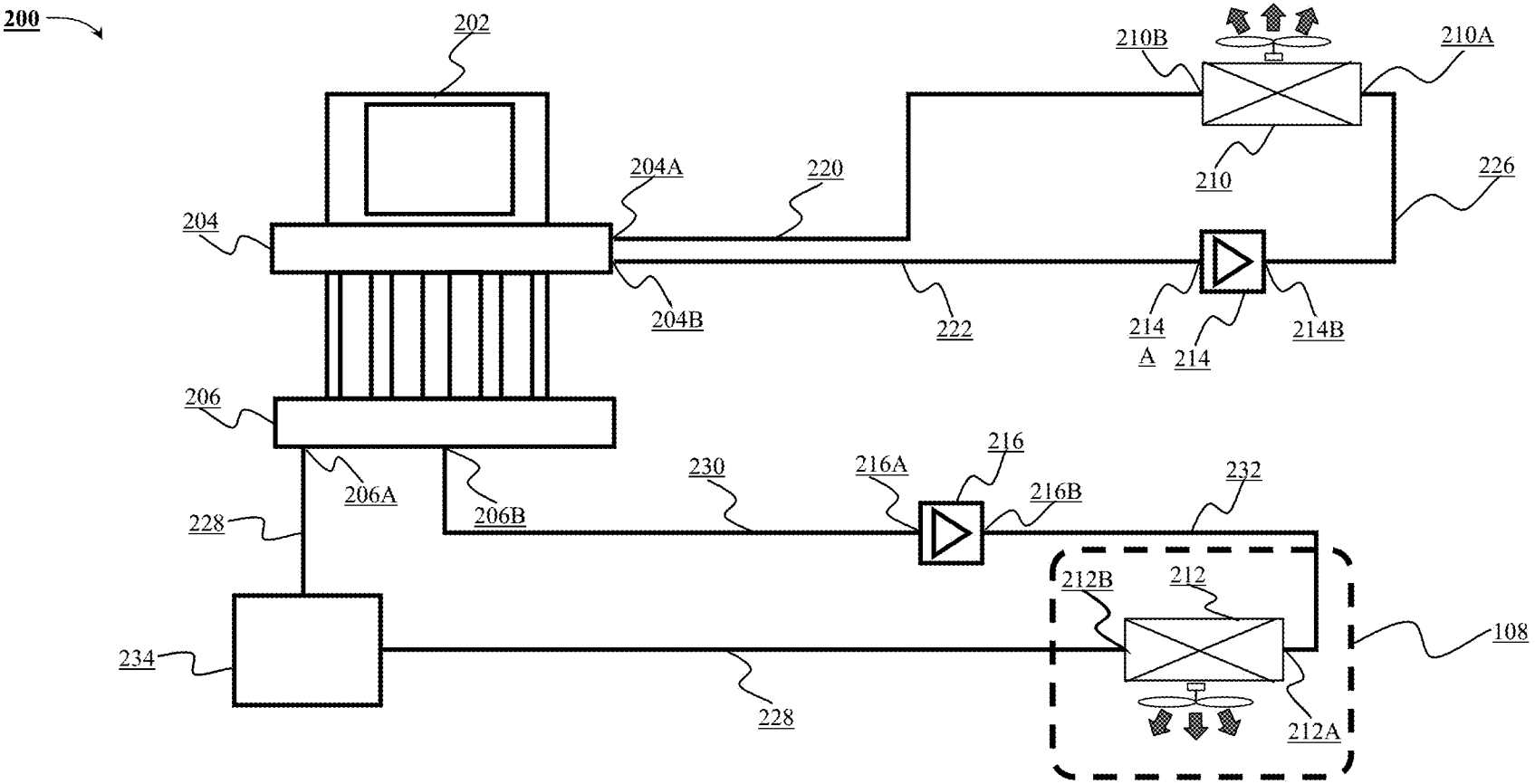
FIG. 2 illustrates a schematic view of a Stirling refrigeration system having a first refrigerant flowing using pumps.

FIG. 2 illustrates a Stirling refrigeration system 200 having pumps. The Stirling refrigeration system 200 may have a similar construction as the Stirling refrigeration system 100 shown in FIG. 1. In one example, the Stirling refrigeration system 200 may include a Stirling unit 202 which may be similar to the Stirling unit 102 shown in FIG. 1. Accordingly, the Stirling unit 202 may have a hot end 204 and the cold end 206. Further, the Stirling refrigeration system 200 includes a hot heat exchanger 210 and a cold heat exchanger 212 similar to their corresponding counterparts in FIG. 1 and hence are not discussed for the sake of brevity. Moreover, the hot end 204 and the hot heat exchanger 210 form the hot circuit and, the cold end 206 and the cold heat exchanger 212 form the cold circuit.

The Stirling refrigeration system 200 may include a first pump 214 and the second pump 216 to regulate the flow of the first refrigerant and the second refrigerant in the hot circuit and the cold circuit respectively. For instance, the hot circuit may include the first pump 214 which has an inlet port 214A and an outlet port 214B. The hot circuit also includes a first hose 220 that fluidically couples an inlet port 204A of the hot end 204 to an outlet port 210B of the hot heat exchanger 210. In addition, the hot circuit includes a second hose 222 that fluidically couples the inlet port 214A of the first pump 214 to an outlet port 204B of the hot end 204. The hot circuit also includes a third hose 226 that fluidically couples the outlet port 214B of the first pump 214 to an inlet port 210A of the hot heat exchanger 210.

Similarly, the cold circuit may include a first hose 228 that fluidically couples an inlet port 206A of the cold end 206 to an outlet port 212B of the cold heat exchanger 212. Further, the cold circuit includes a second hose 230 that fluidically couples the inlet port 216A of the second pump 216 to an outlet port 206B of the cold end 206. Furthermore, the cold circuit may include a third hose 232 that fluidically couples the outlet port 216B of the second pump 216 to the inlet port 212A of the cold heat exchanger 212.

The Stirling refrigeration system 200 also includes a reservoir 234 fluidically coupled to the first hose 228 and stores an additional quantity of the second refrigerant for the cold circuit. During the operation, the reservoir 234 supplies an additional second refrigerant based on the operation of the second pump 216. In one example, the reservoir 234 can be a carbon dioxide cylinder.

During the operation, the motor of the Stirling unit 202, the first pump 214, and the second pump 216 are activated. As a result, the working fluid inside the Stirling unit 202 starts to remove the heat from the cold end 206 and transfers the heat to the hot end 204. In the hot end 204, the first refrigerant absorbs the heat from the hot end 204. Simultaneously, the first pump 214 starts pumping the hot first refrigerant from the hot end 204 via the second hose 222 to the hot heat exchanger 210 via the third hose 226. In the hot heat exchanger 210, the heat from the first refrigerant is discharged to the ambient air. The cooled first refrigerant continues to be pumped back to the hot end 204 via the first hose 220. On the other side, the second pump 216 circulates the second refrigerant through the cold circuit from the cold end 206 to the cold heat exchanger 212 and back to remove the heat from the space 108. The operation of the motor of the Stirling unit 202, the first pump 214, and the second pump 216 can be controlled by a controller to regulate the temperature of space 108.

Figure 3:
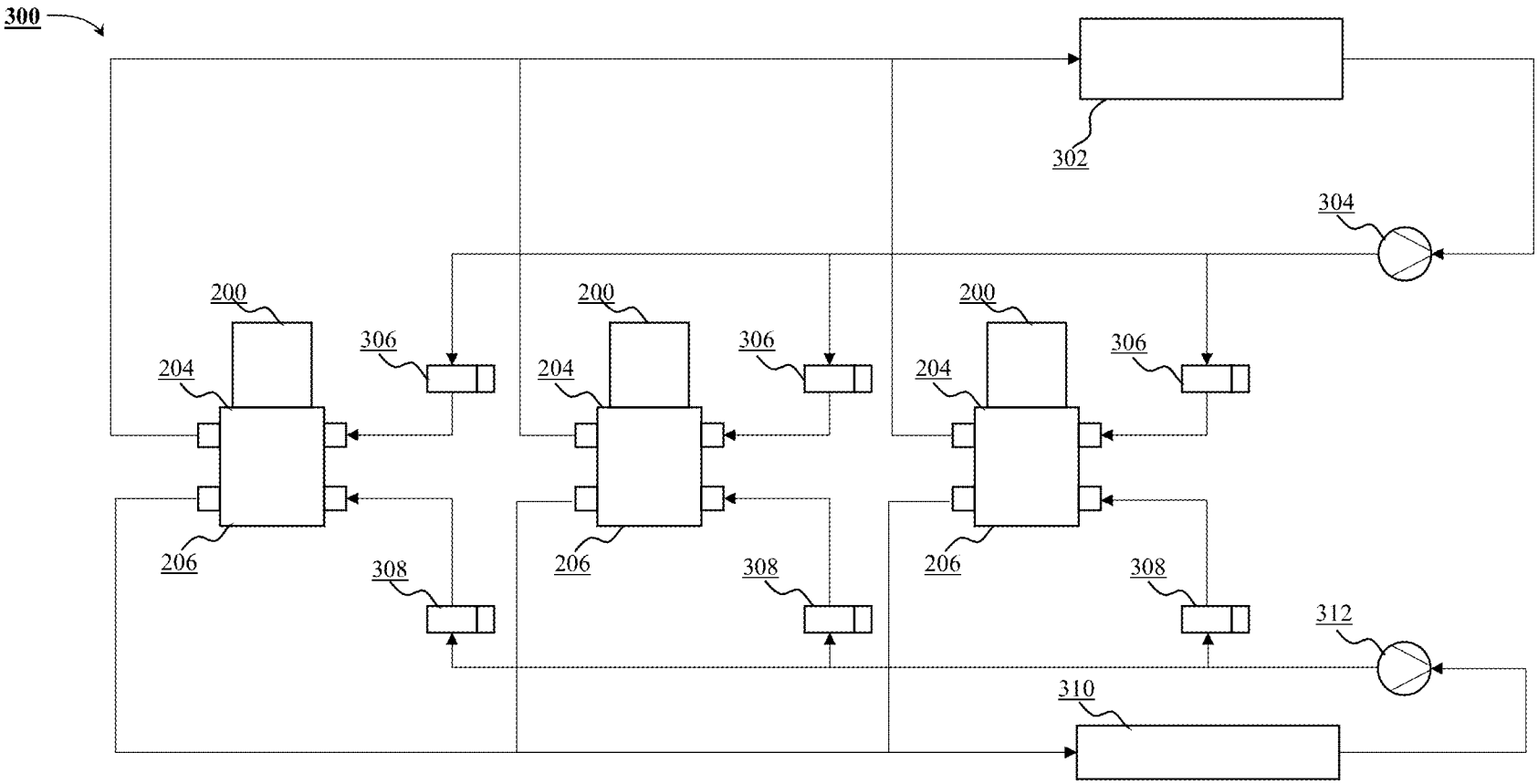
FIG. 3 illustrates a schematic view of multiple Stirling refrigeration systems installed in series.

Multiple units of the Stirling refrigeration system 200 can be installed to cool more than one space. An exemplary embodiment of such a setup is shown in FIG. 3. Specifically, FIG. 3 shows an assembly 300 of multiple Stirling refrigeration systems 200. In the illustrated embodiment, the hot end 204 of each Stirling refrigeration system 200 is connected to a hot heat exchanger 302 which is fluidically coupled to a hot refrigerant pump 304 for circulating the first refrigerant. Further, each Stirling refrigeration system 200 has a first control valve 306 to control the volume of the first refrigerant flowing through the hot end 204 of each Stirling refrigeration system 200. In addition, each Stirling refrigeration system 200 has a second control valve 308 that regulates the flow rate of the second refrigerant into the cold end 206. Further, the cold end 206 of each Stirling refrigeration system 200 is connected to a cold heat exchanger 310 which is fluidically coupled to a cold refrigerant pump 312 for circulating the second refrigerant. Such a configuration may be needed in a scenario where two spaces may be individually cooled.

Figure 4:
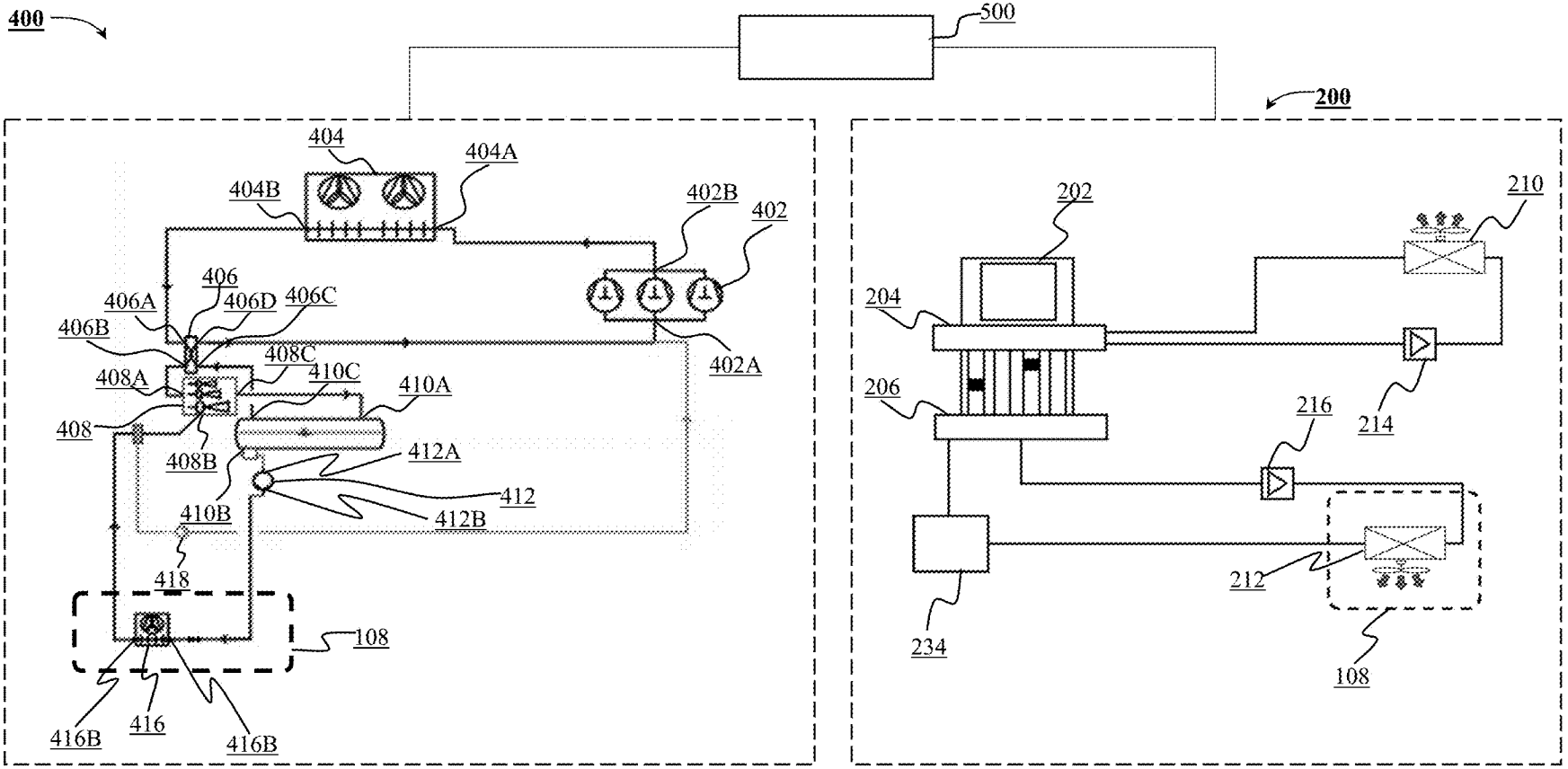
FIG. 4 illustrates a schematic view of an apparatus having a vapour compression refrigeration system and the Stirling refrigeration system.

According to this disclosure, the Stirling refrigeration system 200 or the Stirling refrigeration system 100 can be combined with another type of refrigeration system to achieve different levels of cooling within a space. An exemplary embodiment is shown in FIG. 4 which shows an apparatus having a vapour compression refrigeration system 400 and the Stirling refrigeration system 200, according to an embodiment of the disclosure. The vapour compression refrigeration system 400 may be used to maintain medium a temperature, such as maintaining the temperature below a second temperature, such as below −4 degrees Celsius whereas the Stirling refrigeration system 200 may be used to maintain the temperature, such as maintaining the temperature below a first temperature, such as below −40 degrees Celsius. As may be understood, the second temperature is greater than the first temperature.

The Stirling refrigeration system 200 is identical to the one explained above and hence its description is not repeated for brevity. On the other hand, the vapour compression refrigeration system 400 may include various components that operate synergistically to cool the space 108. For instance, the vapour compression refrigeration system 400 may include a compressor 402, a condenser 404, a fluid exchanger 406, one or more injectors 408, a reservoir 410, a pump 412, an evaporator 414, and a return pump 418.

The compressor 402 can either be a reciprocating type, scroll type, or rotary type compressor configured to compress the third refrigerant to form a compressed refrigerant. Further, the condenser 404 is installed downstream to the compressor 402, such that an outlet port 402B of the compressor 402 is fluidically coupled to an inlet port 404A of the condenser 404 via refrigerant lines. The condenser 404 is a heat exchanger that discharges the heat of the compressed refrigerant to ambient air A. Further, to facilitate the discharge of the heat to the ambient air A, the condenser 404 may include a fan (not shown) that maintains a defined volume of airflow through the condenser 404.

Downstream to the condenser 404 is the fluid exchanger 406 which has multiple inlet ports and outlet ports. In one example, the fluid exchanger 406 has a first inlet port 406A fluidically coupled to an outlet port 404B of the condenser 404 and configured to receive the condensed refrigerant. In addition, the fluid exchanger 406 has a first outlet port 406B fluidically coupled to a first inlet port 408A of the injector 408. In addition, the fluid exchanger 406 has a second inlet port 406C which is fluidically coupled to the reservoir 410 and a second outlet port 406D fluidically coupled to an inlet port 402A of the compressor 402.

Similarly, the injectors 408 may include the first inlet port 408A which is fluidically coupled to the first outlet port 406B of the fluid exchanger 406, a second inlet port 408B, and an outlet port 408C. The reservoir 410 may also include a first inlet port 410A, a first outlet port 410B, and a second outlet port 410C. As shown in FIG. 4, the first inlet port 410A is coupled to the outlet port 408C of the injector 408. Further, the first outlet port 410B is coupled to an inlet port 412A of the pump 412 while the second outlet port 410C is fluidically coupled to the second inlet port 406C of the fluid exchanger 406.

Downstream to the pump 412 is the evaporator 414 having an inlet port 414A fluidically coupled to an outlet port 412B of the pump 412. Further, an outlet port 414B of the evaporator 414 is fluidically to the second inlet port 408B of the injector 408. In addition, the return pump 418 is fluidically coupled to the second inlet port 408B of the injector 408 and to the inlet port 402A of the compressor 402 to divert a major portion of the third refrigerant coming from the evaporator 414 towards the compressor 402. Although not visible, an expansion valve may be disposed downstream to the pump 412 and the evaporator 416 to reduce the pressure of the refrigerant.

According to this disclosure, the operation of the vapour compression refrigeration system 400 and the Stirling refrigeration system 200 can be controlled by a controller 500 that can control both the systems individually based on the amount of cooling needed. In one example, the controller may operate the Stirling refrigeration system 200 to support the cooling of the vapour compression refrigeration system 400 and vice versa.

During the operation, the controller 500 may actuate the compressor 402 to compress the third refrigerant to form a compressed refrigerant. The compressed refrigerant flows into the condenser 404 which rejects the heat from the compressed refrigerant to form condensed refrigerant. The condensed refrigerant flows into the first inlet port 406A of the fluid exchanger 406 which supplies the condensed refrigerant to the injector 408 via its first inlet port 408A. Inside the injector 408, the stream of condensed refrigerant is mixed with a stream of hot refrigerant coming from the evaporator via the second inlet port 408B forming a mixed stream of refrigerant. The mixing of the two streams reduces the pressure of the refrigerant and is collected in the reservoir 410 via its first inlet port 410A. The reservoir 410, based on the requirement, directs the third refrigerant to the pump via its first inlet port 410A to the pump 412. The pump 412 supplies the refrigerant to the evaporator 416 via the expansion valve which cools the third refrigerant. The cooled refrigerant absorbs the heat from the air in the space 108 and exits the evaporator 416 from its outlet port 416B to the second inlet port 408B. Further, a majority of the hot refrigerant is supplied back to the compressor 402 and a stream of a small volume of hot refrigerant is supplied to the injector 408 to reduce the pressure of the condensed refrigerant.

The vapour compression refrigeration system 400 and the Stirling refrigeration system 200 may operate synergistically to distribute their cooling requirement thereby forming a cascade type of refrigeration system. Moreover, the use of the Stirling refrigeration system 200 does away with the need for a compressor for low-temperature requirements thereby alleviating the disadvantage associated with compression-based refrigeration for maintaining lower temperatures. Moreover, both the vapour compression refrigeration system 400 and the Stirling refrigeration system 200 use low GWP refrigerant which makes the vapour compression refrigeration system 400 and the Stirling refrigeration system 200 safer for the environment.

While specific language has been used to describe the disclosure, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

We claim:

1. An apparatus for cooling a space, the apparatus comprising:

a Stirling refrigeration system configured to maintain temperature of the space below a first temperature, the Stirling refrigeration system comprising:

a Stirling unit comprising a hot end and a cold end;

a hot heat exchanger fluidically coupled to the hot end and configured to release the heat form the hot end, wherein the hot heat exchanger and the hot end defining a hot circuit for a first refrigerant to flow therein;

a cold heat exchanger fluidically coupled to the cold end and configured to release the heat form the cold end, wherein the cold heat exchanger and the cold end defining a cold circuit for a second refrigerant to flow therein, wherein at least one of the first refrigerant and the second refrigerant comprises a two-phase low Global Warming Potential (GWP) refrigerant; and a vapour compression refrigeration system configured to maintain temperature of the space below a second temperature, wherein the second temperature is greater than the first temperature.

2. The apparatus according to claim 1, wherein the low GWP refrigerant has a GWP of 0 to 150.

3. The apparatus according to claim 1, wherein the at least one of the first refrigerant and the second refrigerant includes R471A, R516A, R455A, R454C, R454A, R1132, R1234ze, R1234yf, R290, R600, R600a, R744, R1270, or R480A refrigerant.

4. The apparatus according to claim 1, wherein the vapour compression refrigeration comprises:

a compressor configured to compress a third refrigerant.

5. The apparatus according to claim 1, wherein the hot circuit further comprises:

a first hose configured to couple an inlet port of the hot end to an outlet port of the hot heat exchanger;

a first pump having an inlet port and an outlet port;

a second hose configured to couple an inlet port of the first pump to an outlet port of the hot end; and a third hose configured to couple the outlet port of the first pump to an inlet port of the hot heat exchanger.

6. The apparatus according to claim 1, wherein the cold circuit further comprises:

a first hose configured to couple an inlet port of the cold end to an outlet port of the cold heat exchanger;

a second pump having an inlet port and an outlet port;

a second hose configured to couple an inlet port of the second pump to an outlet port of the cold end; and a third hose configured to couple the outlet port of the second pump to an inlet port of the cold heat exchanger.

7. The apparatus according to claim 6, comprising a reservoir fluidically coupled to the first hose of the cold circuit and configured to store the second refrigerant for supplying to the cold circuit.

8. The apparatus according to claim 1, wherein the hot circuit further comprises:

a first hose configured to couple an inlet port of the hot end to an outlet port of the hot heat exchanger; and a second hose configured to couple an outlet port of the hot end to an inlet port of the hot heat exchanger.

9. The apparatus according to claim 1, wherein the cold circuit further comprises:

a first hose configured to couple an inlet port of the cold end to an outlet port of the cold heat exchanger; and a second hose configured to couple an outlet port of the cold end to an inlet port of the cold heat exchanger.

10. An apparatus for cooling a space, the apparatus comprising:

a Stirling refrigeration system configured to maintain temperature of the space below a first temperature, the Stirling refrigeration system comprising:

a Stirling unit comprising a hot end and a cold end; and a two-phase low Global Warming Potential (GWP) refrigerant; and a vapour compression refrigeration system configured to maintain temperature of the space below a second temperature, wherein the second temperature is greater than the first temperature.

11. The apparatus according to claim 10, wherein the Stirling refrigeration system further comprises:

a hot heat exchanger and a cold heat exchanger;

wherein the hot heat exchanger and the hot end define a hot circuit for a first refrigerant to flow therein; and wherein the cold heat exchanger and the cold end define a cold circuit for a second refrigerant to flow therein.

* * * * *